US007407418B1

(12) United States Patent
Harlan

(10) Patent No.: US 7,407,418 B1
(45) Date of Patent: Aug. 5, 2008

(54) ADAPTER FOR CONNECTING A LOW VOLTAGE LIGHT BULB TO A STANDARD ELECTRICAL LIGHT SOCKET

(76) Inventor: Whil Harlan, 32742 Alipaz, #12, San Juan Capistrano, CA (US) 92675

( * ) Notice: Subject to any disclaimer, the term of this patent is extended or adjusted under 35 U.S.C. 154(b) by 0 days.

(21) Appl. No.: 11/906,014

(22) Filed: Oct. 1, 2007

(51) Int. Cl.
*H01R 24/00* (2006.01)

(52) U.S. Cl. ..... 439/699.2; 439/641

(58) Field of Classification Search ..... 439/611–613, 439/619, 641, 643, 699.2
See application file for complete search history.

(56) References Cited

U.S. PATENT DOCUMENTS 2,227,743 A 1/1941 Bone et al.
5,989,070 A 11/1999 Al-Turki et al.
6,338,647 B1 * 1/2002 Fernandez et al. ..... 439/490
6,863,573 B1 3/2005 Kohler
7,192,315 B2 * 3/2007 Powers et al. ..... 439/699.2

* cited by examiner

*Primary Examiner*—Khiem Nguyen
(74) *Attorney, Agent, or Firm*—Morland C. Fischer

(57) ABSTRACT

A lamp socket adapter to receive a relatively low cost, low voltage (e.g., wedge base or bipin) light bulb so that the light bulb can be powered from a source of 12 volts AC or DC. The lamp socket adapter of this invention is adapted to be rotated into mating engagement with a standard Edison-type lamp socket that is to be connected to receive one of an AC or DC voltage. By virtue of the foregoing, an efficient light bulb circuit is available by which one or more low voltage light bulbs can provide bright light over an area to be illuminated with reduced power consumption relative to a conventional 120 volt AC-powered incandescent light bulb. The lamp socket adapter includes an upstanding bulb pedestal to which the light bulb is attached and supported. First and second electrically-conductive strips extend through the lamp socket adapter by which to connect the low voltage light bulb seated upon the bulb pedestal to the Edison lamp socket so that the light bulb can be powered by the 12 volts AC or DC supplied to the lamp socket.

16 Claims, 3 Drawing Sheets

ADAPTER FOR CONNECTING A LOW VOLTAGE LIGHT BULB TO A STANDARD ELECTRICAL LIGHT SOCKET

BACKGROUND OF THE INVENTION

1. Field of the Invention

This invention relates to an adapter to be coupled to a low voltage (e.g., 12 volts) light bulb for rotation into mating engagement with a standard Edison-type lamp socket in place of the usual 120 volt AC-powered light bulb. By virtue of the foregoing, a relatively small, energy-efficient light bulb, which is known to provide bright light, can be connected to receive a supply of AC or DC voltage in substitution of a relatively large, energy-inefficient 120 volt AC-powered bulb.

2. Background Art

For many years, it has been common in homes and businesses to use 120 volt AC-powered incandescent light bulbs connected to a lamp, or the like, to provide a source of light. Such an AC-powered light bulb is rotated (i.e., screwed) into mating engagement with a well-known Edison lamp socket. An electrical cord extends from the Edison socket of the lamp to be connected to an electrical wall receptacle at which to receive a supply of 120 volts AC to power the light bulb. However, it is well known that using the conventional AC-powered light bulb results in an inefficient consumption of energy. In fact, energy-conscious consumers are searching for a viable energy-efficient alternative for the standard AC-powered light bulb. In this same regard, the standard 120 volt AC-powered incandescent light bulb has a relatively short life expectancy. Therefore, the overall cost to the consumer to light a room is undesirably high. What is more, because of its relatively large size, the AC-powered incandescent light bulb is not well suited for recessed lighting applications.

For all of these reasons, it would be desirable to provide a means by which a commercially-available, compact and energy-efficient low voltage AC or DC-powered light bulb can be substituted for the relatively large, costly, and energy-inefficient 120 volt AC-powered light bulb, but without requiring a special lamp socket or having to alter the electrical wall receptacle to which the lamp socket is connected. In this same regard, it would also be desirable to be able to provide power to a plurality of low voltage light bulbs that are coupled to respective lamp sockets interconnected with one another in a lighting system, but without having to add a voltage converter at each lamp socket.

SUMMARY OF THE INVENTION

In general terms, a lamp socket adapter is disclosed that is capable of being rotated into mating engagement with a standard Edison-type lamp socket to be connected to an electrical wall receptacle. By virtue of the lamp socket adapter of this invention, a commercially-available, compact and energy-efficient low voltage light bulb (e.g., such as a wedge-base bulb or a bipin bulb) can be coupled to the Edison lamp socket at which to receive a supply of 12 volts AC or DC, but without having to alter the lamp socket or add a 120 volt to 12 volt converter thereto.

The lamp socket adapter includes a cylindrical base that is sized for removable receipt by the Edison lamp socket. A conductive center pole located at the bottom of the base and a conductive screw thread surrounding the base are moved into contact with corresponding electrical contacts of the lamp socket. A bulb pedestal stands upwardly from the base to establish a support to which the low voltage bulb is attached. In a first preferred embodiment, where a wedge-base bulb is to be coupled to the adapter, the bulb pedestal has a hollow receptacle within which the bulb is received and retained. Pairs of contacts run through the bulb pedestal by which terminals of the wedge-base bulb are electrically connected to the lamp socket adapter. In a second preferred embodiment, where a bipin bulb is to be coupled to the adapter, the bulb pedestal has a pair of pin holes extending vertically therethrough to receive respective ones of a pair of conductive pins from the bulb. The pins extending through the pair of pin holes are electrically connected to the lamp socket adapter. A first electrically-conductive strip runs through the base of the lamp socket adapter from the center pole thereof to the bulb pedestal at which to be connected to a first terminal/pin of the low voltage light bulb. A second electrically-conductive strip runs through the base of the lamp socket adapter from the screw thread thereof to the bulb pedestal at which to be connected to a second terminal/pin of the low voltage light bulb.

A plurality of low voltage (e.g., wedge base and/or bipin) light bulbs can be interconnected to one another in a lighting circuit to receive a 12 volt AC or DC supply at the lamp sockets to which respective lamp socket adapters have been mated. A suitable AC or DC voltage can be supplied to the lamp sockets, for example, from a battery, a transformer that is electrically connected to an AC wall receptacle, or a transformer that is connected via a dedicated circuit to the AC breaker box of a house or other residential facility to be lighted.

DESCRIPTION OF THE PREFERRED EMBODIMENT

Figure 1A:
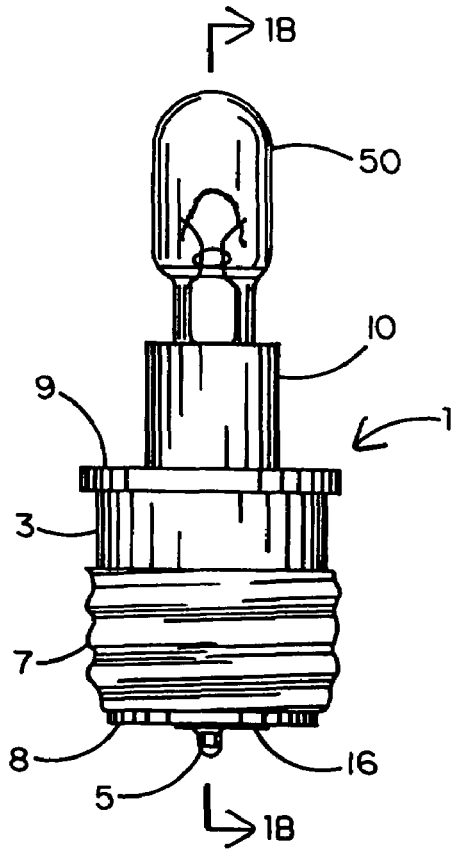
FIG. 1A shows a lamp socket adapter according to a first preferred embodiment of this invention having a low voltage wedge-base light bulb attached thereto.
Figure 1C:
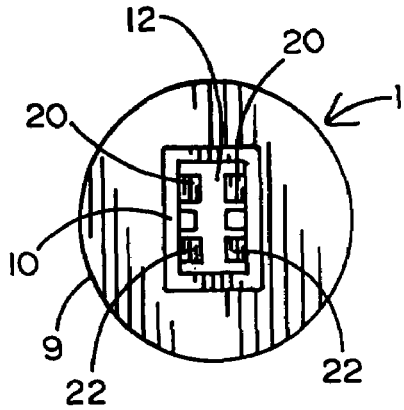
FIG. 1C is a top view of the lamp socket adapter of FIG. 1A.
Figure 1B:
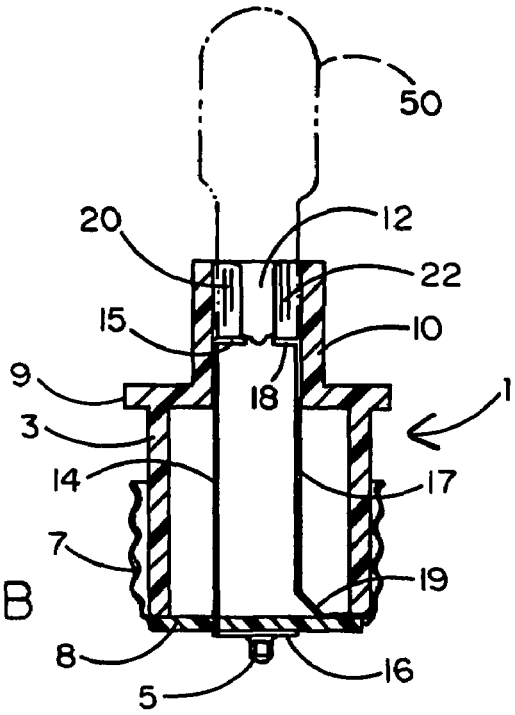
FIG. 1B is a cross section of a lamp socket adapter of FIG. 1A.

Referring initially to FIGS. 1A, 1B and 1C of the drawings, there is shown a lamp socket adapter 1 according to a first preferred embodiment to which a first small, commercially-available low voltage wedge base bulb 50 is to be coupled. As will soon be explained, the lamp socket adapter 1 is rotated into mating engagement with a standard lamp socket (sometimes known as an Edison socket) of the kind that has heretofor been connected by means of an electrical cord to a source of 120 volts AC at an electrical wall receptacle commonly found in houses and office buildings. However, as will also be explained, a 12 volt AC or DC source (e.g., a battery or an AC to DC voltage converter or an AC to AC transformer) is interconnected with the standard lamp socket so that the wedge base bulb 50 of this embodiment can be powered instead by a supply of low voltage.

Thus, by virtue of the lamp socket adapter 1 herein disclosed, an off-the-shelf, low voltage wedge base bulb 50 which is known to be a source of bright light, can be coupled to a standard lamp socket that is connected to receive a supply of 12 volts AC or DC. In this same regard, the relatively high cost and energy inefficient 120 volt AC-powered incandescent light bulb that is usually screwed into the lamp socket can now be replaced by a lower cost, more energy efficient bulb that is capable of generating more light.

Figure 3:
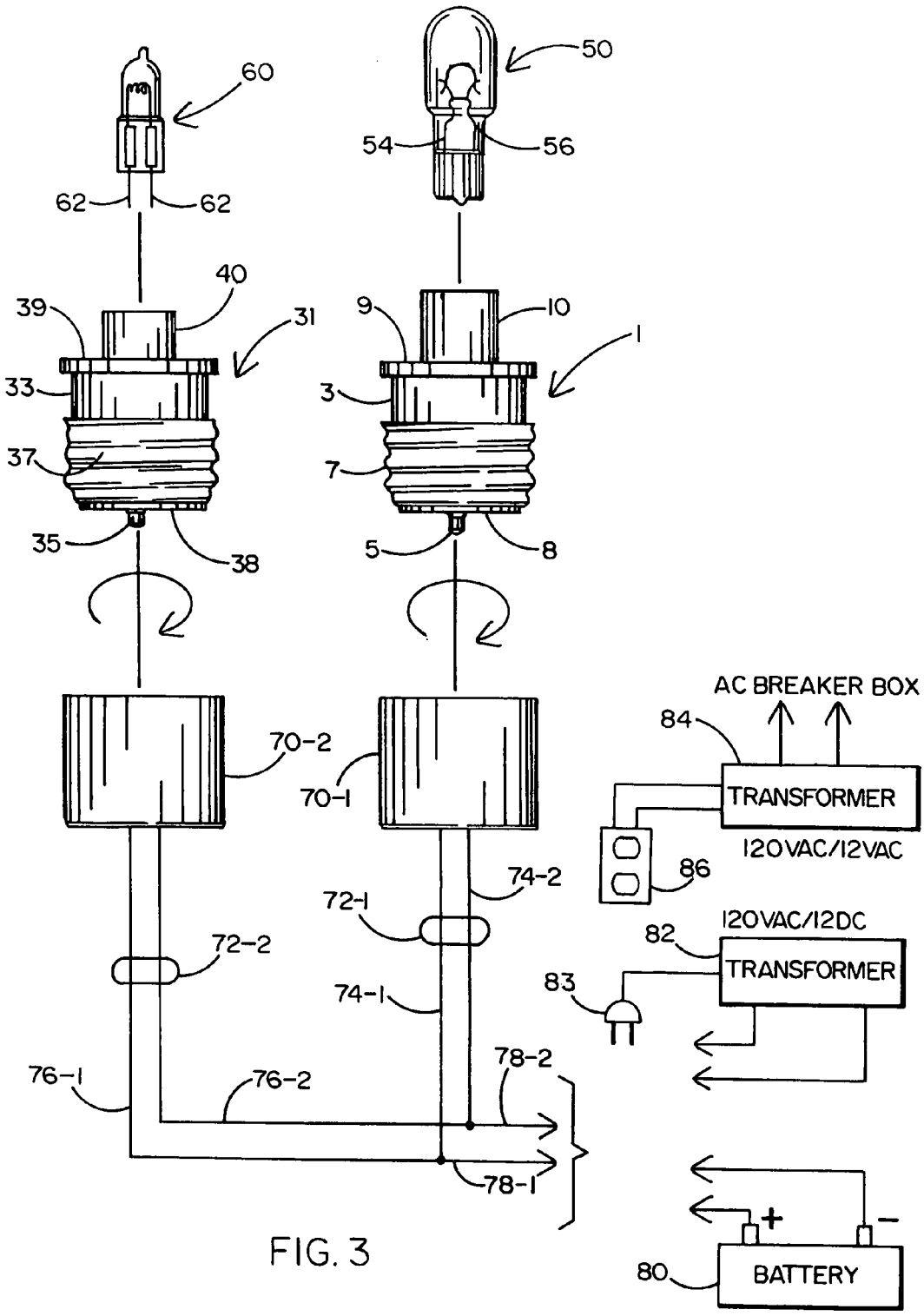
FIG. 3 shows a lighting system wherein low voltage light bulbs are to be attached to respective ones of the lamp socket adapters of FIGS. 1A and 1B which, in turn, are to be mated to respective Edison-type lamp sockets for receiving a supply of 12 volts AC or DC.

The lamp socket adapter 1 shown in FIGS. 1A, 1B and 1C includes a generally cylindrical base 3 that is manufactured from an electrical insulator (e.g., porcelain) material and is sized for receipt by the standard lamp socket (designated 70-1 in FIG. 3). An electrically-conductive center pole 5 projects downwardly from the bottom of the socket base 3. An electrically-conductive screw thread 7 surrounds the socket base 3 above the center pole 5. The center pole 5 and screw thread 7 are electrically isolated from one another by means of an insulating disk 8 extending therebetween. When the adapter 1 is mated to the lamp socket, the center pole 5 and screw thread 7 thereof are electrically connected to corresponding electrical contacts of the lamp socket.

A socket grip 9 extends horizontally across the top of the socket base 3 to provide a convenient gripping surface at which a rotational force can be applied to cause the screw thread 7 of socket adapter 1 to rotate into receipt by the standard Edison lamp socket. A rectangular bulb pedestal 10 is coextensively connected to and stands upwardly from the socket adapter 1 at the socket grip 9.

The bulb pedestal 10 is manufactured from an electrical insulator and has a size and shape to provide a seat for supporting the wedge base bulb 50 thereupon so that the bulb can be connected to receive a supply of 12 volts AC or DC in a manner that will be explained in greater detail hereinafter. To this end, and as is best shown in FIGS. 1B and 1C, the upstanding bulb pedestal 10 includes a hollow receptacle 12 within which the base (52 in FIG. 3) of the wedge base bulb 50 is pushed and frictionally engaged. First and second pairs 20 and 22 of electrical contacts run vertically through the bulb pedestal 10 to engage corresponding wire terminals (54 and 56 in FIG. 3) of the wedge base bulb 50 when the bulb is pushed into receipt by bulb pedestal 10. The bulb pedestal 10 provides a reliable support for attaching and electrically connecting bulb 50 to the lamp socket adapter 1.

As is best shown in FIG. 1B, a first electrically-conductive strip 14 runs vertically through the insulating base 3 of lamp socket adapter 1. Conductive strip 14 has a first terminal 15 at one end thereof that is aligned to contact a first of the pairs of electrical contacts 20 from the bulb pedestal 10. Conductive strip 14 has a second terminal 16 at the opposite end thereof that is connected to the center pole 5 through the insulating disk 8. A second electrically-conductive strip 17 also runs vertically through the insulator base 3 alongside but spaced from the first conductive strip 14. Conductive strip 17 has a first terminal 18 at one end thereof that is aligned to contact the second pair of electrical contacts 22 from the bulb pedestal 10. Conductive strip 17 has a second terminal 19 at the opposite end thereof that is connected to the conductive screw thread 7 which surrounds the base 3 of lamp socket adapter 1.

Figure 2A:
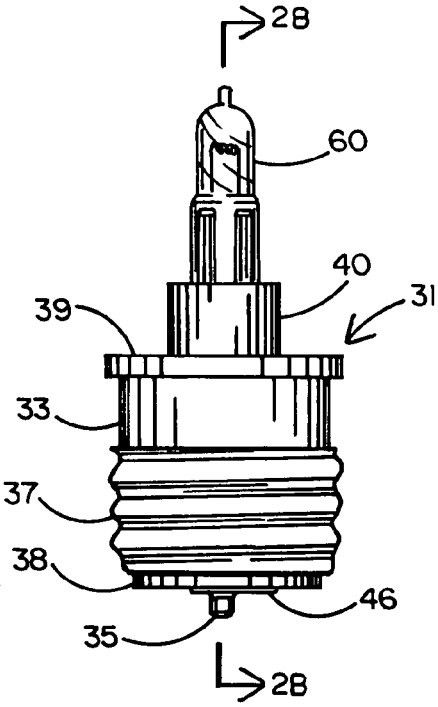
FIG. 2A shows a lamp socket adapter according to a second preferred embodiment of this invention having a low voltage bipin bulb attached thereto.
Figure 2C:
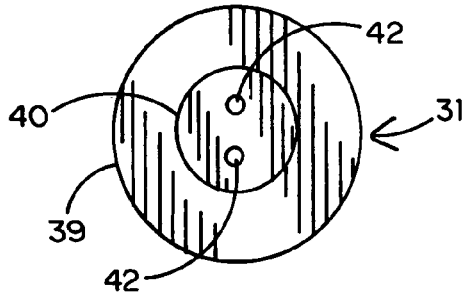
FIG. 2C is a top view of the lamp socket adapter of FIG. 2A.
Figure 2B:
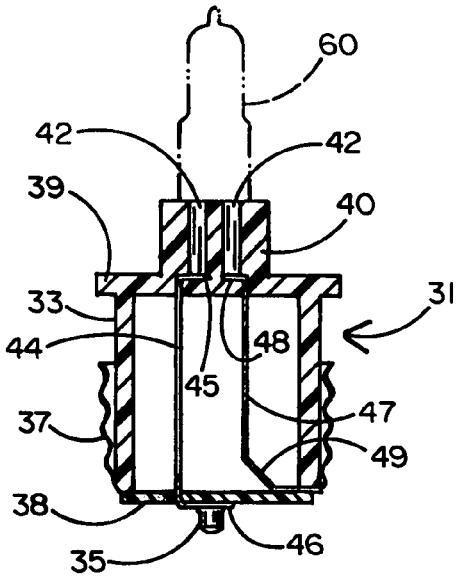
FIG. 2B is a cross section of the lamp socket adapter of FIG. 2A.

Turning now to FIGS. 2A, 2B and 2C of the drawings, there is shown a lamp socket adapter 31 according to a second preferred embodiment of this invention. The lamp socket adapter 1 of FIGS. 1A, 1B and 1C is particularly adapted to enable a wedge base bulb 50 to be electrically connected to a standard Edison lamp socket. The lamp socket adapter 31 of FIGS. 2A, 2B and 2C is particularly adapted to enable a different low voltage light bulb (e.g., a small, commercially-available low voltage bipin bulb 60) to be electrically connected to the same type of lamp socket to achieve the same advantages as those described above with regard to lamp socket adapter 1. Thus, the lamp socket adapter 31 of this embodiment will permit the low voltage bipin bulb 60, which is also known to be a source of bright light, to be powered from a standard lamp socket to which is connected a 12 volt AC or DC source (e.g., a battery or an AC to DC voltage connector or an AC to AC transformer). Hence, the relatively high cost and energy inefficient 120 volt AC-powered light bulb can now be replaced by another off-the-shelf light bulb that is capable of generating more light at lower cost and greater energy efficiency.

Like the lamp socket adapter 1 of FIGS. 1A, 1B and 1C, the lamp socket adapter 31 of FIGS. 2A, 2B and 2C includes a generally cylindrical base 33 that is manufactured from an electrical insulator and sized for receipt by the lamp socket (designated 70-2 in FIG. 3). An electrically-conductive center pole 35 projects downwardly from the socket base 33. An electrically-conductive screw thread 37 surrounds the socket base 3 above the center pole 35. The center pole 35 and screw thread 37 are electrically isolated from one another by means of an insulating disk 38 extending therebetween.

A socket grip 39 extends horizontally across the top of the socket base 33 to provide a convenient gripping surface at which a rotational force can be applied to cause the screw thread 37 of socket adapter 31 to rotate into receipt by the standard lamp socket. A cylindrical bulb pedestal 40 is coextensively connected to and stands upwardly from the socket adapter 31 at the socket grip 39.

The bulb pedestal 40 is manufactured from an electrical insulator and has a size and shape to provide a seat for supporting the bipin bulb 60 thereupon so that the bulb can be connected to receive a supply of 12 volts AC or DC. As is best shown in FIGS. 2B and 2C, the upstanding bulb pedestal 40 includes a pair of spaced, parallel-aligned pin holes 42 running vertically therethrough. The pin holes 42 are positioned relative to one another to receive respective ones of a pair of pins (designated 62 in FIG. 3) of the bipin bulb 60 so that the bulb pedestal 40 will provide a reliable support for attaching and electrically connecting bulb 60 to the lamp socket adapter 31.

As is best shown in FIG. 2B, a first electrically-conductive strip 44 runs vertically through the insulating base 33 of lamp socket adapter 31. Conductive strip 44 has a first terminal 45 at one end thereof that is aligned with a first one of the pair of pin holes 42 through bulb pedestal 40 at which to engage one pin of the bipin bulb 60. Conductive strip 44 has a second terminal 46 at the opposite end thereof that is connected to the center pole 35 through insulating disk 38. A second electrically-conductive strip 47 also runs vertically through the insulator base 33 alongside but spaced from the first conductive strip 44. Conductive strip 47 has a first terminal 48 at one end thereof that is aligned with the second of the pair of pin holes 42 through bulb pedestal 40 at which to engage the second pin of the bipin bulb 60. Conductive strip 47 has a second terminal 49 at the opposite end thereof that is connected to the conductive screw thread 37 which surrounds the base 33 of lamp socket adapter 31.

Referring to FIG. 3 of the drawings, there is shown an electrical lighting system including a single lamp socket adapter 1 of FIGS. 1A, 1B and 1C and a single lamp socket adapter 31 of FIGS. 2A, 2B and 2C. Although the lighting system illustrated at FIG. 3 only shows a single lamp socket adapter 1 and 31, it is to be understood that the system can also include a plurality of lamp socket adapters 1 and 31 or all of one type of socket adapter 1 or 31, depending upon the light bulbs to be coupled thereto. In the case of the socket adapter 1, a low-voltage wedge base bulb 50 is shown being moved into receipt by the bulb pedestal 10 thereof. Therefore, bulb 50 will be carried by socket adapter 1, and the pair of wire terminals 54 and 56 of bulb 50 will be electrically connected via the pairs of contacts (20 and 22 of FIG. 1C) running through bulb pedestal 10 to respective ones of the first and second electrically-conductive strips (14 and 17 of FIG. 1B) that run vertically through the base 3 of socket adapter 1 to center pole 5 and screw thread 7. In the case of the socket adapter 31, a low-voltage bipin bulb 60 is shown being moved into receipt by the bulb pedestal 40 thereof. Therefore, bulb 60 will be carried by socket adapter 31, and the pair of pins 62 of bulb 60 will be electrically connected through pin holes (42 of FIG. 2B) of bulb pedestal 40 to respective ones of the first and second electrically-conductive strips (44 and 47 in FIG. 2B) that run vertically through the base 33 of socket adapter 31 to center pole 35 and screw thread 37.

In this same regard, any one of a variety of small, commercially-available bipin bulbs can be connected to the lamp socket adapter 31. By way of example, rather than the bipin bulb 60 shown in FIG. 3, a low profile MR16 bipin flood bulb (not shown) may otherwise be used so as to have particular application in recessed lighting environments. Such a recessed lighting application may not be practical with the much larger 120 volt AC-powered light bulbs that are more commonly coupled to a lamp socket.

As previously disclosed, a rotational force applied to the socket grips 9 and 39 of each lamp socket adapter 1 and 31 cause the adapters to be screwed into mating engagement and electrical connection with respective Edison-type lamp sockets 70-1 and 70-2. It may therefore be appreciated that the lamp socket adapters 1 and 31 of the present invention to which the relatively small, energy-efficient 12 volt AC or DC-powered light bulbs 50 and 60 are coupled replace the relatively large 120 volt AC-powered light bulbs which are typically screwed directly into the Edison sockets 70-1 and 70-2. As will be known to those skilled in the art, each Edison socket includes a (e.g., 2-wire) electrical cord 72-1 and 72-2 having a plug (not shown) that is suitable for connection to the usual AC wall receptacle.

As also previously disclosed, rather than being powered from a 120 volt AC source, each wedge base bulb 50 and bipin bulb 60 is powered from a low-voltage 12 volt AC or DC source. To provide power from the same voltage source to the low-voltage bulbs 50 and 60 of the lighting system shown in FIG. 3, the electrical cords 72-1 and 72-2 are interconnected such that the hot wires 74-1 and 76-1 are tied together and the common or ground wires 74-2 and 76-2 are also tied together. A pair of system output wires 78-1 and 78-2 are then connected from the aforementioned interconnections to a suitable source of 12 volts AC or DC.

By way of a first example, the system output wires 78-1 and 78-2 can be connected to the terminals of a battery 80. Suitable 12-volt DC batteries include a standard automobile or marine battery. By way of another example, the system output wires 78-1 and 78-2 can be connected directly to a transformer 82 for outdoor lighting applications, or the like. In this example, the plug 83 of the transformer 82 is plugged into a 120 volt AC wall receptacle so that transformer 82 functions as a 120 volt AC/12 volt DC voltage converter. By way of yet another example, a 120 volt AC/12 volt AC transformer 84 is tied to the 120 volt main at the AC breaker box of a residential or commercial building. In this example, a specially-dedicated circuit is established between the AC breaker box and an AC wall receptacle 86 by way of the transformer 84. The system output wires may also be connected to receive other supplies of AC or DC voltage including that generated by a solar panel, and the like. In each one of the aforementioned examples, the lamp socket adapters 1 and 31 enable small, energy-efficient low voltage light bulbs 50 and 60 to be coupled to a standard Edison socket so that light can be supplied to the surrounding environment which is brighter than that available from the conventional 120 volt AC-powered bulbs.

The invention claimed is:

1. A lamp socket adapter to be mated to a lamp socket by which electrical power delivered to the lamp socket can be supplied to a light bulb that is attached to the lamp socket adapter, said lamp socket adapter comprising:

an electrically-insulating base;

an electrically-conductive screw thread surrounding said base by which to enable said lamp socket adapter to be rotated into mating engagement with and coupled to the lamp socket;

an electrically-conductive center pole projecting downwardly from said base;

a first electrical conductor located within said base and having a first terminal connected to said screw thread and a second terminal positioned to make contact with a first electrical contact of the light bulb to be attached to said lamp socket adapter; and a second electrical conductor located within said base and having a first terminal connected to said center pole and a second terminal positioned to make contact with a second electrical contact of the light bulb.

2. The lamp socket adapter recited in claim 1, further comprising a bulb pedestal to establish a seat for supporting the light bulb and attaching the light bulb to said lamp socket adapter so that the first and the second contacts of the light bulb will be aligned to make contact with the second terminal of each of said first and second electrical conductors located within said base.

3. The lamp socket adapter recited in claim 2, wherein said bulb pedestal is hollow so as to create a receptacle within which to receive at least some of the light bulb to be attached to said lamp socket adapter so that the first and the second contacts of the light bulb will be aligned to make contact with the second terminal of each of said first and second electrical conductors within said base.

4. The lamp socket adapter recited in claim 3, wherein the second terminals of said first and second electrical conductors extend inwardly of the receptacle of said bulb pedestal at which to make electrical contact with respective ones of the first and second contacts of the light bulb.

5. The lamp socket adapter recited in claim 2, wherein said bulb pedestal includes a pair of pin holes extending therethrough within which the first and second contacts of the light bulb are received to make electrical contact with respective ones of the second terminals of said first and second electrical conductors within said base.

6. The lamp socket adapter recited in claim 2, wherein said bulb pedestal is coextensively connected to and stands upwardly from said base to support the light bulb thereupon and thereby attach the light bulb to said lamp socket adapter.

7. An electrical system by which one of 12 volts AC or DC can be supplied to a plurality of low voltage light bulbs, said electrical system comprising:

a plurality of low voltage light bulbs;

a corresponding plurality of lamp sockets, each lamp socket having an electrical cord extending therefrom to be connected to a source of 12 volts AC or DC; and a plurality of lamp socket adapters coupled to respective ones of said plurality of lamp sockets at which to receive 12 volts AC or DC from said source thereof to which the electrical cords of said plurality of lamp sockets are to be connected, said plurality of low voltage light bulbs being attached to corresponding ones of said plurality of lamp socket adapters and electrically connected to corresponding ones of said plurality of lamp sockets through said lamp socket adapters.

8. The electrical system recited in claim 7, wherein at least one of said plurality of low voltage light bulbs is a wedge base bulb.

9. The electrical system recited in claim 7, wherein at least one of said plurality of low voltage light bulbs is a bipin bulb.

10. The electrical system recited in claim 7, wherein said source of 12 volts DC is a battery, each of the electrical cords of said plurality of lamp sockets being interconnected with one another and electrically connected to said battery, whereby said plurality of low voltage light bulbs are connected in electrical parallel.

11. The electrical system recited in claim 7, wherein said source of 12 volts DC includes a 120 volt AC to 12 volt DC voltage converter, each of the electrical cords of said plurality of lamp sockets being interconnected with one another and electrically connected to said voltage converter, whereby said plurality of low voltage light bulbs are connected in electrical parallel.

12. The electrical system recited in claim 7, wherein said source of 12 volts AC includes a 120 volt AC to 12 volt AC voltage converter, each of the electrical cords of said plurality of lamp sockets being interconnected with one another and electrically connected to said voltage converter, whereby said plurality of low voltage light bulbs are connected in electrical parallel.

13. The electrical system recited in claim 7, wherein at least one of said plurality of lamp socket adapters includes:

an electrically-insulating base;

an electrically-conductive screw thread surrounding said base by which to enable said lamp socket adapter to be rotated into mating engagement with a corresponding one of said plurality of lamp sockets;

an electrically-conductive center pole projecting downwardly from said base;

a first electrical conductor located within said base and having a first terminal connected to said screw thread and a second terminal to make electrical contact with a first contact of a corresponding one low voltage light bulb attached to said lamp socket adapter; and a second electrical conductor located within said base and having a first terminal connected to said center pole and a second terminal to make electrical contact with a second contact of said corresponding one low voltage light bulb.

14. The electrical system recited in claim 13, wherein said at least one lamp socket adapter also includes a bulb pedestal projecting from said base thereof to establish a seat for supporting said one low voltage light bulb thereupon, whereby said one low voltage light bulb is attached to said one lamp socket adapter so as to lie in electrical contact with said first and second electrical conductors located within said base.

15. The electrical system recited in claim 14, wherein said bulb pedestal is hollow so as to create a receptacle within which to receive at least some of said one low voltage light bulb to be attached to said at least one lamp socket adapter so that the first and second contacts of the low voltage light bulb are aligned to make contact with the second terminals of each of said first and second electrical conductors located within said base.

16. The electrical system recited in claim 15, wherein the second terminals of said first and second electrical conductors located within said base extend inwardly of the hollow receptacle of said hollow bulb pedestal of said at least one lamp socket adapter at which to make electrical contact with respective ones of the first and second contacts of said one low voltage light bulb.

* * * * *